US005465978A

United States Patent [19]

Magnone et al.

[11] Patent Number: 5,465,978

[45] Date of Patent: Nov. 14, 1995

[54] TRAINING APPARATUS FOR LAUNCHING SOCCER BALLS

[76] Inventors: Jean-Pierre Magnone, 47 boulevard J.D. Blanqui, 06340 La Trinite, France; Roberto Uttinacci, Via Verbano, 6, I-28041 Arona, Italy

[21] Appl. No.: 167,911

[22] PCT Filed: Jun. 23, 1992

[86] PCT No.: PCT/FR92/00568

§ 371 Date: Dec. 20, 1993

§ 102(e) Date: Dec. 20, 1993

[87] PCT Pub. No.: WO93/00138

PCT Pub. Date: Jan. 7, 1993

[30] Foreign Application Priority Data

Jun. 24, 1991 [FR] France ..... 91 07846

[51] Int. Cl.[6] ..... A63B 69/00

[52] U.S. Cl. ..... 273/411

[58] Field of Search ..... 273/129 R, 129 V, 273/411; 124/54, 7

[56] References Cited

U.S. PATENT DOCUMENTS

| | | | |
|---|---|---|---|
| 3,470,859 | 10/1969 | Ponza | 124/7 |
| 4,015,578 | 4/1977 | Wright | 124/7 |
| 4,122,822 | 10/1978 | Scheiwiller | 124/54 |
| 4,345,577 | 8/1982 | Andersson | 273/411 |
| 4,615,528 | 10/1986 | York | 273/411 |
| 4,641,834 | 2/1987 | Hegedus | 273/411 |

FOREIGN PATENT DOCUMENTS

| | | |
|---|---|---|
| 649142 | 10/1964 | Belgium . |
| 2334381 | 7/1977 | France . |
| 2716643 | 10/1978 | Germany . |
| WO86/05109 | 9/1986 | WIPO . |

*Primary Examiner*—Theatrice Brown
*Attorney, Agent, or Firm*—Young & Thompson

[57] ABSTRACT

Training apparatus for launching balls, particularly footballs, of the type using a supply containing the balls (3). The balls (3) are gravity fed one at a time by a chute (4) to a launching station (5) having an ejection arm. The lower end (8) of the chute (4) for supplying the balls (3), which opens at the level of the launching station (5), is provided with a single distributor for the balls (3). The ejection arm is mounted fixedly on an axle mounted on bearings and provided with a return spring. A launching arm is also mounted on the axle, and is actuated by a drive arm which strikes the launching arm in rotation. The drive arm comprises adjustment element which permits varying its radius so as to give more or less power to its lever arm. The launching station (5) is formed by a cradle which is provided with elements for adjustment in a horizontal direction and in a vertical direction. The apparatus is used for football training.

5 Claims, 5 Drawing Sheets

TRAINING APPARATUS FOR LAUNCHING SOCCER BALLS

FIELD OF THE INVENTION

The invention has for its object an electromechanical training apparatus for launching balls, particularly footballs.

BACKGROUND OF THE INVENTION

The state of the art can be defined by the following patents:

FR-A-2,334.381 "Process for launching footballs toward a predetermined emplacement, characterized by the fact that the balls are withdrawn from a supply, mechanically or by gravity, they are dispatched one by one to a launching station and are launched by applying to the desired position a blow whose force is adjustable. There is applied to the ball a blow oriented as desired horizontally or upwardly. The position of the point of impact on the ball can be modified over a range comprised between the horizontal median plane of the ball and the plane passing through the center of this ball and making with this horizontal plane a downward angle greater than 30°. The percussion is graded by a plunger having substantially the length of the leg and oscillating in the manner of a lever. The apparatus comprises a supply of balls, a device for emplacing these balls, which opens at the launching station, and a percussion mechanism, as well as a control apparatus for this emplacement device and of this mechanism."

FR-A-2.433.956: "Apparatus comprising according to the principal patent a supply, a launching station and an emplacement device permitting removing balls from the supply and placing them individually in the launching station, this apparatus comprising moreover a striking mechanism and a control apparatus adapted to permit the launching of the balls with a force whose intensity is adjustable and whose point of impact on the ball can be selected. The device is mounted on a pivoting lever, the pivoting of this lever permitting adjusting the position of the percussion mechanism relative to the ball. Use for training football players."

FR-A-2.409.059: "Apparatus for launching balls characterized in that it comprises a tube provided at one of its ends with an opening of a section greater than the size of the balls to be launched, as well as a supply device connected to a supply of balls adapted to introduce a ball into the tube, the tube enclosing an expulsion device adapted to expel the ball from the tube at a given moment and under predetermined conditions."

FR-A-2.580.507: "The invention relates to sporting equipment. The device which is the object of the invention is characterized particularly in that the synchronization mechanism for the movements of the pusher and the striker comprise a crank connected mechanically to the pusher and mounted on a drive shaft supported by the base, disposed substantially parallel to the control shaft and turning in a direction opposite to the latter, the crank being movable in rotation, conjointly with the drive shaft and at the speed of this latter, as well as at a speed higher than this latter during the displacement of a ball by the pusher toward the striking position. It is advantageous to use the device in question to launch balls or the like for training particularly tennis players, football players, hockey players."

FR-A-2.577.813: "The invention relates to sporting equipment. The device which is the object of the invention is characterized in that it comprises a chamber for the securement of balls or the like, in striking position, connected to the separator, communicating with this latter, enclosing the pusher and formed by lateral walls, an upper wall and a lower wall, one of said lateral walls being disposed on one side of the plane of angular displacement of the striker, transversely to the control shaft, while the function of the lateral wall opposite to the lateral wall is fulfilled by the pusher in the course of the securement of the balls or the like and said walls of the chamber being traversed by openings for entry and exit of the striker and for the passage of the balls or the like that are launched. The device in question can be used particularly for training tennis players, football players, hockey players."

There can also be cited the patents:

DE-A-2 716 643

BE.A.649142: the invention has for its object a ball-launching apparatus, particularly for launching tennis balls, characterized by the following points, taken separately or in combination:

1° The ball-launching apparatus is constituted by at least one frame on which is pivoted an arm which is moved by resilient means and whose one end strikes the ball, maintained in the apparatus by gripping, to impart to this ball the necessary impulse for its launching.

EP 0 213 195: process for launching balls, in which the ball from an initial launching position for launching in a retention member, is accelerated along the path of acceleration by an arm that moves along a circular trajectory and is then freed, characterized in that at the end of the acceleration trajectory, the direction of the norm of the force of the striking arm, which passes through the center of the ball and at the point of impact, coincides with the desired launching direction, and in that to achieve launching of the ball subject to a gyratory movement and whose direction of launching can be selected, the retention element is displaced about a center of rotation, the radius of rotation of the retention element corresponding essentially to the radius of the circular trajectory of the striking arm.

All these patents describe adjustable automatic ball launchers. These ball launchers have numerous drawbacks.

Numerous apparatus do not perform these multiple functions: adjustable stroke power, trajectory adjustable in length, trajectory adjustable in height, drive to left or right, adjustable frequency of launching, precision of launching.

The apparatus which perform multiple functions have the drawbacks of being expensive and cumbersome; because of their complexity, they are hardly reliable and their maintenance is costly. It is not possible to obtain two adjustments at the same time.

Moreover, none of these documents provides on the same axle, two arms, one for ejection and the other for throwing.

The document FR-A-2.334.381 proposes an ejection arm having laterally a roller, this structure has the drawback that the intense and repetitive effort for loading the apparatus, to work the ejection arm forcibly; force which will be the greater, the greater is the distance between the arm and the roller, will be great. This torsion force does not lead to reliability.

The apparatus according to the invention comprises all the multiple functions for a better training result. Moreover, the apparatus according to the invention is simple in conception, therefore reliable, and easy to maintain. It is less cumbersome. It can work in two horizontal and vertical directions. Finally, it is of much lower cost than the equivalent apparatus now on the market. It is therefore within reach of all sporting clubs.

The apparatus is a machine for launching footballs which permits training from infants to professional players and this, for all the technical measures which require the attendance of another person, short balls to the feet and to the chest, return of a volley, head game and training (specific to the goal). Thanks to these five characteristics: adjustable drive power, oriented drive angle, variable frequency of launching, electronic distance control, high capacity ball supply, this apparatus is the indispensable complement to the trainer. The mechanism and the operation of the apparatus are simple and entirely electromechanical, which gives a sturdiness and absolute reliability. The only elements subject to wear are the rotation bearings and the principal spring. Their replacement requires no special qualification. The electrical apparatus operates on 24 volts and it is therefore absolutely safe and conforms to European standards. The mains supply is 220 volts.

To this end, the training apparatus to launch balls, particularly footballs, is of the type using a supply containing the balls, said balls are conducted by a chute and by gravity, one by one, to a launching station, where means serving as an ejection arm strikes them by a percussion point that is adjustable by adjustment means and with a force that is adjustable by means for adjusting the power of the blow. The lower end of the chute for supplying the balls, which opens at the launching post, is provided with a single ball distributor, such as an articulated lever actuated by an electromagnet, so as to liberate one by one the balls which descend by gravity with the chute.

The apparatus is characterized by the fact that the ejection arm is mounted fixedly on an axle mounted on bearings and provided with a return spring on which is also mounted a launching arm, said launching arm is actuated by a drive arm which arms the launching arm in rotation, the drive arm comprises adjustment means which permit varying its radius so as to stress more or less the return spring.

The launching station is formed by a cradle which receives the ball before it is struck, said cradle is provided with adjustment means in horizontal translation and in vertical translation.

According to an embodiment, the axle on which are mounted the ejection arm and the launching arm is provided with a stop abutment.

The adjustment means which permits adjusting the radius of the drive arm is a hollow rotatable shaft mounted between two bearings, a moto-reducer turning this shaft on which is mounted perpendicularly the drive arm, this arm is provided with a toothed rack which engages with a pinion disposed in the hollow shaft, said pinion is actuated by an axle provided at its end with a hand wheel which emerges outside the apparatus and thus permits adjusting the radius of the drive arm.

The means for adjusting the cradle in translation are, for horizontal translation, a rod which is actuated by a moto-reducer, while the cradle is mounted on horizontal slideways.

For vertical translation, the cradle is provided with vertical columns along which the cradle can rise or fall through the action of cams fixed to a horizontal shaft which is actuated in rotation by a moto-reducer, a transmission chain and wheels.

The accompanying drawings are given by way of non-limiting examples. They show a preferred embodiment according to the invention. They permit easy comprehension of the invention.

DETAILED DESCRIPTION OF THE INVENTION

Figure 1:
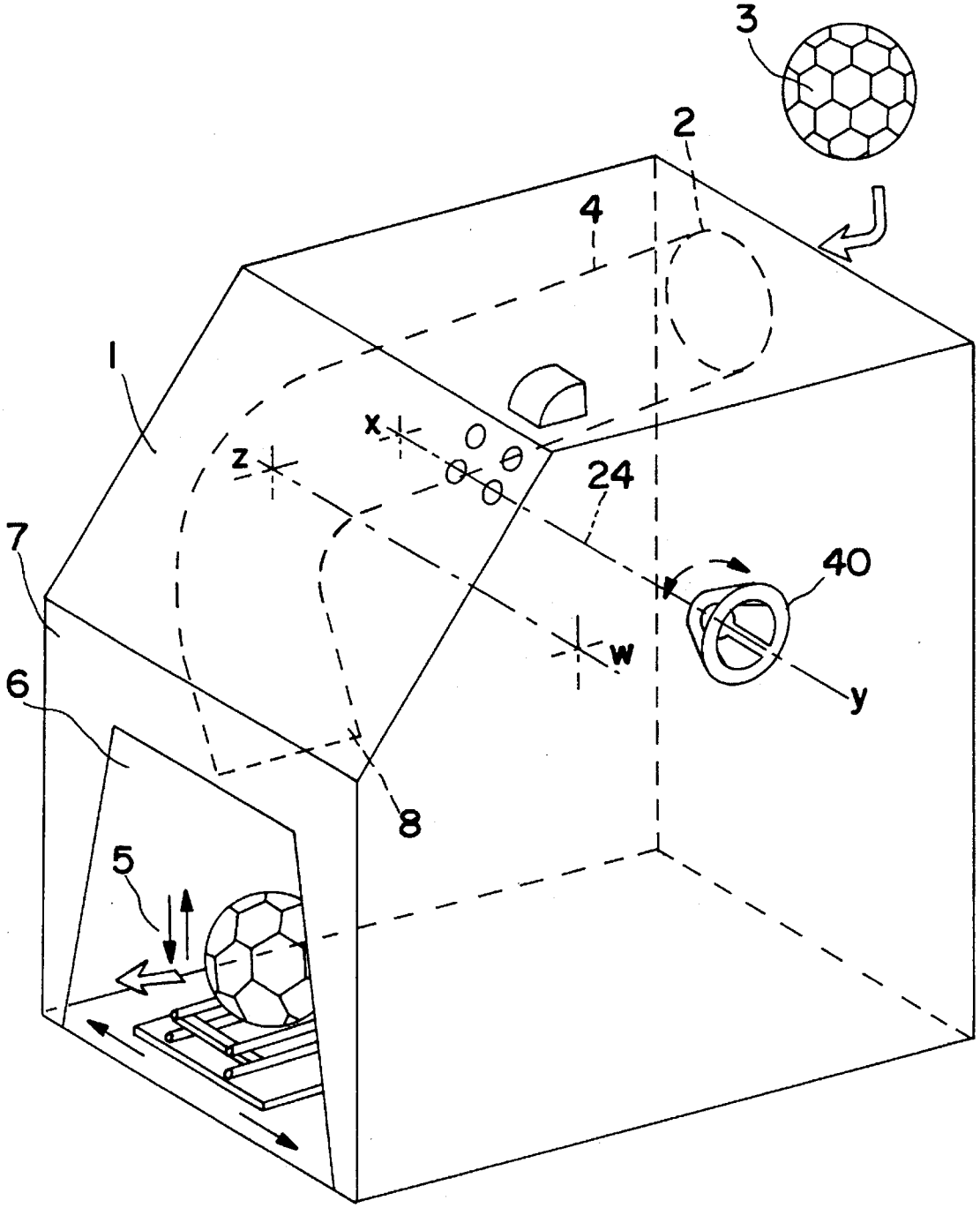
FIG. 1 is a schematic view of the apparatus, showing the supply chute for balls, the launching station with its cradle, the adjusting hand wheel of the launching force.
Figure 8:
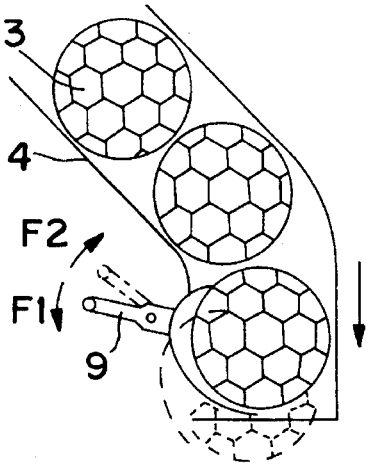
FIG. 8 is a view of the lower end of the supply chute for balls with its ball distributor.

The apparatus to launch balls is represented in perspective in FIG. 1. This apparatus is disposed in a casing 1 with, in its upper portion, an opening 2 which permits supplying balls 3 to the apparatus. This opening 2 leads to a supply containing said balls 3. The balls 3 are conducted by a chute 4 to a launching station 5 which opens through a window 6 on the forward surface 7 of the apparatus. The lower end 8 of the supply chute 4 for the balls 3 opens at the level of the launching station 5. This end 8 of the chute 4 is provided with a single ball distributor, such as an articulated lever 9, actuated by an electromagnet not shown in the figure, so as to release one by one the balls 3 which descend by gravity through the chute 4. The arrows F1 and F2 show in FIG. 8 the action of the articulated lever 9 which frees one by one the balls 3 which fall by gravity through the chute 4.

In FIGS. 2, 3, 4 and 5 are shown means for adjusting the force for launching and ejecting the ball.

Figure 4:
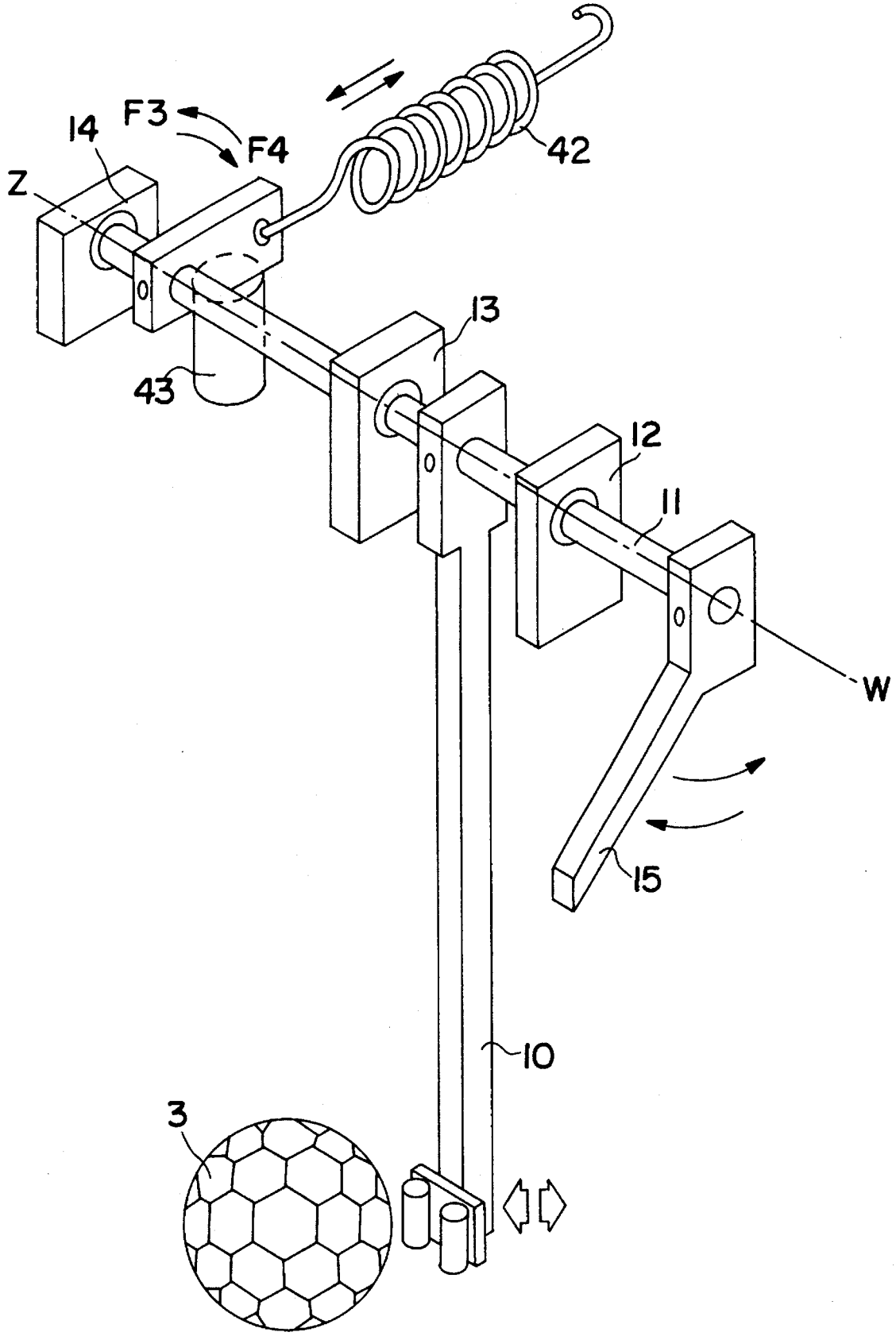
FIG. 4 is a perspective view of the ejection arm, of the launching arm, of the axle on which they are mounted, of the bearings of this axle and of the return spring that the drive arm, adjustable in length, can more or less stress.
Figure 5:
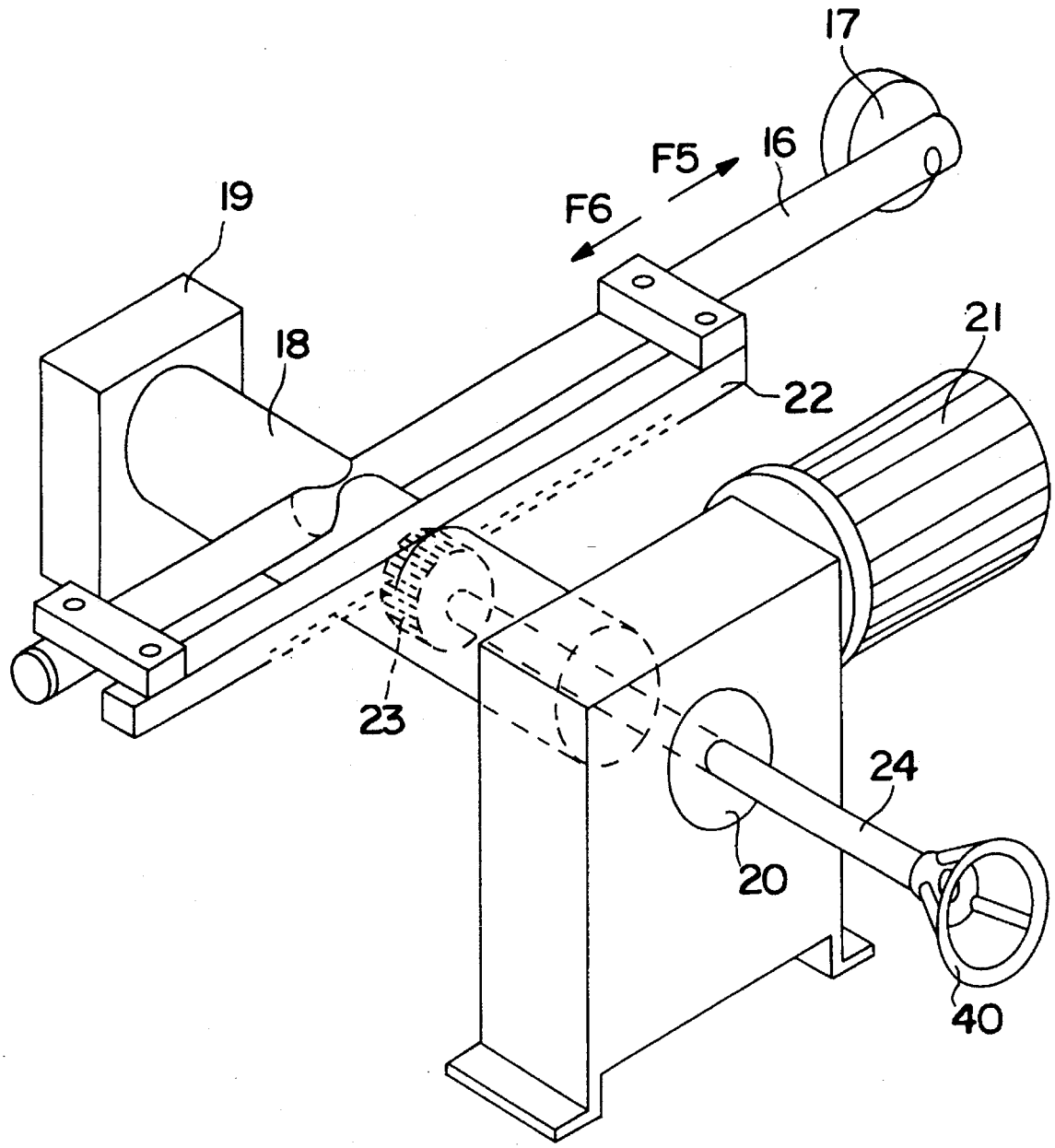
FIG. 5 is a perspective view of the drive arm and of the adjustment means of its radius.
Figure 6:
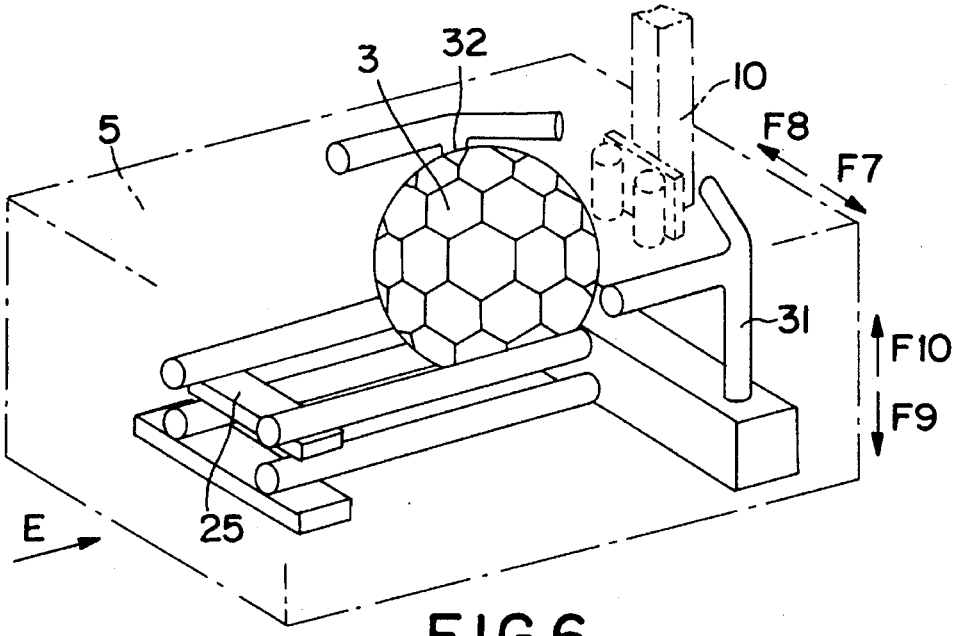
FIG. 6 is a perspective view of the cradle.
Figure 7:
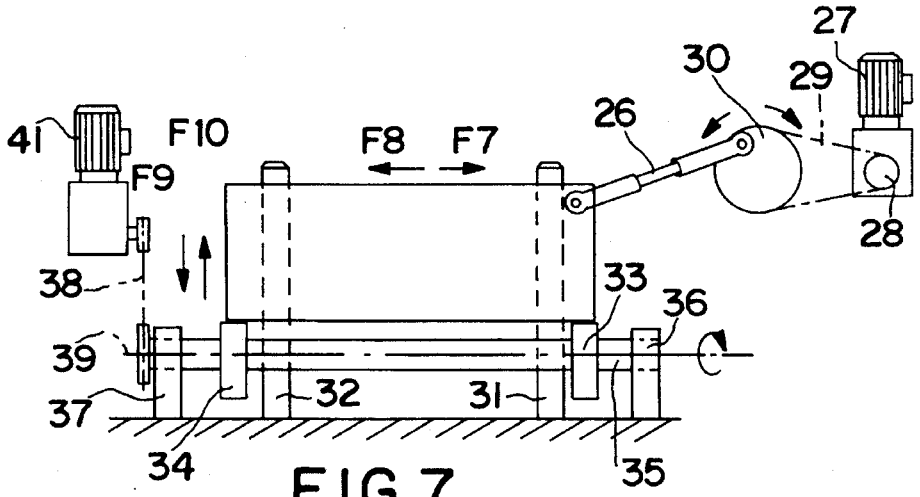
FIG. 7 is an elevational view of the launching station including the cradle depicted in phantom lines in the direction E shown in FIG. 6.

In FIG. 4, the ejection arm 10 is mounted fixedly on an axle 11, mounted in bearings 12, 13, 14. This axle 11 can turn in the direction of the arrows F3, F4. On this axle 11 is also mounted a launching arm 15 which also swings in the direction of the arrows F3 and F4. On this axle 11 are mounted a return spring 42 and a stop abutment 43.

Figure 2:
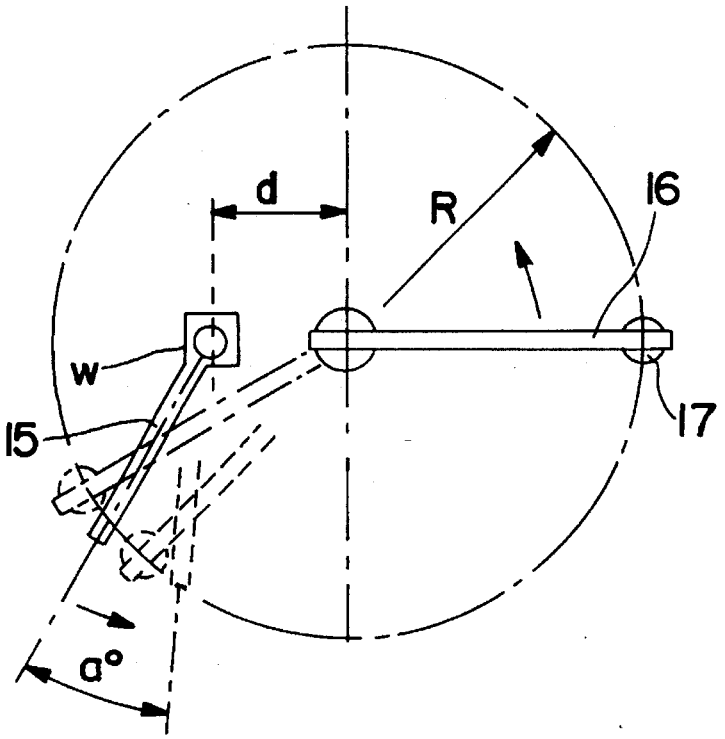
FIG. 2 is a schematic view showing the action of the drive arm which arms the launching arm with a radius R which stresses the return spring over a short course.
Figure 3:
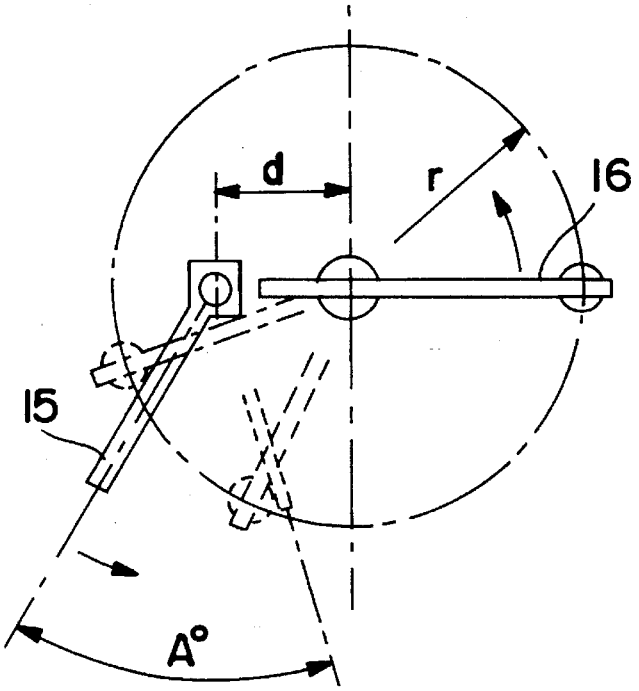
FIG. 3 is a view according to FIG. 2, but in which the radius "r" is smaller, which increases the path which permits less stress of the return spring.

As shown in FIGS. 2 and 3, the launching arm 15 is cocked by the drive arm 16. To this end, the drive arm 16 is adjustable in length and rotatable, its end terminates in a roller 17 which comes into contact with the launching arm 15. The axes of rotation of the two arms 15 and 16 are spaced apart a distance d. Upon turning, the drive arm 16 comes into contact, by its roller 17, with the launching arm 15, which turns the launching arm 15 and hence the axle 11 and thus stresses the return spring 42 and this until the end of the drive arm escapes with its roller 17 the circular arc, over a radius R, will thus be a (see FIG. 2).

For a radius r of the drive arm 16 which is adjustable in length, the axis of the circle will be A, the spring 42 will be more stressed than in the preceding case, there will therefore be obtained after escape of the drive arm 16 from the launching arm 15, a very great launching power for the ejection arm 10 which strikes the ball 3.

The adjustment means which permits adjusting the radius of the drive arm 16 is a hollow shaft 18 which is rotatable and mounted between two bearings 19 and 20. A moto-reducer 21 causes said shaft 18 to turn, on which is mounted perpendicularly the drive arm 16. This drive arm 16 is provided with a toothed rack 22 which engages with a pinion 23 disposed within the hollow shaft 18. The pinion 23 is actuated in rotation by an axle 24 provided at its end with a handle wheel 40 which is manipulable from outside the apparatus 1 and which permits, by turning the pinion 23 on the toothed rack, the adjustment of the radius of the drive arm 16, in a direction F5 or F6, which increases or decreases said radius of the drive arm 16 whose roller 17 comes into contact with the launching arm 15 to stress more or less the return spring 42.

The launching station 5 is comprised by a cradle 25 which receives the ball 3 to be launched before it is struck. The cradle 25 is provided with adjustment means in horizontal translation F8, F7, and in vertical translation F10, F9.

The means of adjustment in translation of the cradle 25 are for horizontal translation F8, F7, a rod 26 which is actuated by a moto-reducer 27. The shaft of said moto-reducer 27 drives a wheel 28, a chain 29 and actuates a crank plate 30 which maneuvers the cradle 25. The cradle 25 is mounted on horizontal slideways (not shown).

For vertical translation, the cradle 25 is provided with vertical columns 31, 32 along which the cradle 25 can mount or descend by the action of the cams 33, 34 fixed to a horizontal shaft 35, mounted on bearings 36 and 37. The horizontal shaft 35 is actuated in rotation by a moto-reducer 41 and a transmission chain 38 which acts on a pinion 39, disposed at the end of the horizontal shaft 35.

REFERENCES

1. Casing
2. Opening of the casing
3. Balls
4. Chute
5. Launching station
6. Window
7. Forward surface of the apparatus
8. Lower end of the chute
9. Articulated lever
10. Ejection arm
11. Axle
12. 13. 14. Bearings
15. Launching arm
16. Drive arm
17. Roller
18. Hollow shaft
19. 20. Bearings
21. Moto-reducer
22. Toothed rack
23. Pinion
24. Axle of the pinion
25. Cradle
26. Rod
27. Moto-reducer
28. Wheel
29. Chain
30. Crank plate
31. 32. Vertical columns
33. 34. Cams
35. Horizontal shaft
36. 37. Bearings
38. Transmission chain
39. Pinion
40. Hand wheel
41. Moto-reducer
42. Return spring
43. Stop abutment
F1, F2, F3, F4, F5, F6, F7, F8, F9, F10. Arrows
R. Large radius of the drive arm
r. Small radius of the drive arm
d. Distance between drive arm and launching arm

We claim:

1. Training apparatus for launching balls, comprising: means for supplying a plurality of balls to a chute for gravity feeding the balls one at a time to a launching station, said chute having a lower end which opens at the level of the launching station and includes a single ball distributor, said distributor comprising an articulated lever actuated by an electromagnet so as to free said balls one at a time as they descend by gravity through the chute, said launching station including an ejection arm for striking said balls at a striking point with an adjustable force, said ejection arm being fixedly mounted on an axle mounted on bearings, said axle having a return spring attached thereto and a launching arm mounted thereon, said launching arm being actuated by an operatively associated rotatable drive arm which rotates the launching arm about said axle, said drive arm including adjustment means for varying the radius of the drive arm so as to stress the return spring and thereby generate said adjustable force, said launching station comprising a cradle for receiving a ball at said striking point, first cradle adjustment means for adjusting said cradle in a horizontal direction, and second cradle adjustment means for adjusting said cradle in a vertical direction.

2. Training apparatus according to claim 1, further including stop abutment means for preventing rotation of the return spring about said axle.

3. Training apparatus according to claim 1, wherein the adjustment means for varying the radius of the drive arm comprises a hollow shaft rotatably mounted between two bearings, a moto-reducer for turning said shaft on which said drive arm is mounted perpendicularly, said drive arm having a toothed rack which engages with a pinion disposed in the hollow shaft, said pinion being actuated by axle means having a hand wheel at one end thereof, said hand wheel being disposed outside the apparatus for varying the radius of the drive arm.

4. Training apparatus according to claim 1, wherein the first cradle adjustment means includes a rod which is actuated by a moto-reducer while the cradle is mounted for horizontal movement.

5. Training apparatus according to claim 1, wherein the second cradle adjustment means comprise vertical columns along which the cradle can rise or fall under the action of cams fixed to a horizontal shaft which is actuated in rotation by a moto-reducer, a transmission chain and pinions.

* * * * *